United States Patent [19]

Tankred et al.

[11] 4,115,035

[45] Sep. 19, 1978

[54] MOTOR COMPRESSOR

[75] Inventors: Hans Jürgen Tankred, Sonderborg; Per Johan Madsen, Nordborg, both of Denmark

[73] Assignee: Danfoss A/S, Nordborg, Denmark

[21] Appl. No.: 786,508

[22] Filed: Apr. 11, 1977

[30] Foreign Application Priority Data

Apr. 21, 1976 [DE] Fed. Rep. of Germany ..... 2617370

[51] Int. Cl.[2] ..... F04B 17/00

[52] U.S. Cl. ..... 417/312; 417/417; 417/902; 29/156.4 R

[58] Field of Search ..... 417/417, 312, 902; 29/156.4, 156.4 WL

[56] References Cited

U.S. PATENT DOCUMENTS 3,666,380 5/1972 Ellis ..... 417/902

FOREIGN PATENT DOCUMENTS 213,931 3/1961 Australia ..... 417/902
1,501,090 11/1970 Fed. Rep. of Germany ..... 417/415
1,292,632 10/1972 United Kingdom ..... 417/902

*Primary Examiner*—C. J. Husar
*Attorney, Agent, or Firm*—Wayne B. Easton

[57] ABSTRACT

The invention relates to a refrigeration type motor compressor assembly in which an integrated motor compressor unit is resiliently mounted in a sealed casing. A skeleton-like frame facilitates integrating the motor and compressor with a minimum amount of structural material. This frame includes a shaft bearing member and a cylinder member for the compressor function, these two members being joined by a beam member which is attached to the bearing member and extends to the cylinder member. The beam member has support posts depending therefrom which rest on the upper surface of the stator laminations.

7 Claims, 5 Drawing Figures

MOTOR COMPRESSOR

The invention relates to a motor compressor, particularly the motor compressor of a small refrigerator resiliently mounted in its capsule, wherein a cylinder component is unified with the bearing for the main shaft and made in one piece with a supporting device which is fixed against rotation on the stack of stator laminations and which has a base surface seated on the end face of the stack of stator laminations.

In known motor compressors, a substantially cup-shaped supporting member is provided of which the perimeter serves as a supporting device of which the peripheral base surface is seated on the end of the stack of stator laminations, which stack carries the bearing for the main shaft in the middle and on which a cylinder component is screwed tight. When the cylinder component was later unified with the bearing, i.e. made in one piece with the supporting member, the outline of this supporting member was substantially retained. However, such a construction uses a comparatively large amount of material.

The invention is based on the problem of providing a motor compressor which requires very little material.

This problem is solved according to the invention in that the supporting device extends only in the region of the cylinder or no more than a short distance to both sides thereof, that the bearing is connected to the component by a cantilever beam and that, for taking up the moment occurring by reason of the one-sided attachment, the radial dimension of the base surface pressed against the end face by at least one bolt is selected accordingly and/or use is made of attachment means taking up the moment.

In this construction a supporting member is completely omitted. The bearing is merely connected to the cylinder component by a cantilever beam. The supporting device extends along a much shorter portion than hitherto. However, this supporting device must not only transmit the weight and motor forces as hitherto but also a moment. This moment is difficult to control, whether by bolt tightening forces in conjunction with pressures between the end face of the stack of stator laminations and the appropriately dimensioned base surface, or by an attachment device which can take out a moment by engaging in the supporting device, or by a combination of these features. Since only the supporting device and the cantilever beam are required in addition to the bearing, the cylinder and possibly sound damping chambers associated therewith, the amount of material required is very small.

With particular advantage, the component has in addition to the cylinder a sound damping chamber to each side thereof and the supporting device is covered by the component at least to a large extent. The component itself therefore strengthens the supporting device which itself retains its small size.

It is also recommended that the beam be substantially triangular with its limbs extending substantially symmetrically from the bearing and that parts of the supporting device be disposed at the ends of the limbs. With this beam triangle, the base is formed by the cylinder and by the component which possibly has the sound dampers. Consequently there will be considerable stability with a small amount of material used. By reason of its shape, it permits a direct flow of force between the bearing and the supporting device.

The attachment means may in particular comprise two stator bolts passing through the stack of stator laminations and two tapped holes in the supporting device extending from the base surface. The provision of tapped holes in a supporting member is known per se for engagement by the stator bolts required to hold the stack of stator laminations together. In the present case, however, use is made not only of the tensile force of the bolts but also of their property of being able to take up a considerable moment if they engage deeply enough in the tapped hole. When using two such bolts it is also ensured that the supporting device cannot turn. However, the same effect can also be achieved by using one bolt and additional locking pins.

Although the supporting device can be formed by a continuous wall, it is recommended that the supporting device should consist of only two supporting feet arranged to both sides of the cylinder. This has the advantage of a further saving in material. In addition, space is available between the feet for forming the head of the winding.

In particular, the supporting feet may be seated at the corners of a packet of stator laminations of approximately rectangular cross-section. At this position there is adequate space for giving the supporting feet a sufficiently large base surface, particularly in the radial direction. In addition, the stator bolts are normally located at that position.

The main force flow between the bearing and supporting feet extends along the limbs of the beam triangle. It is therefore recommended that these limbs be at least partially formed by stamped-out stays.

In particular, the stays may be enlarged towards the base surface to form a transition section to the supporting device. This results in additional stiffening.

In an extreme case, the beam triangle can be formed by two stays adjoining the component. However, since little space remains in any case between the bearing and the component, the material between the limbs of the beam triangle can be allowed to form a closed wall to increase the stiffness even further.

Preferably, the beam triangle is arranged so that the cylinder and the sound damping chambers are disposed substantially on one side and the supporting device and bearing substantially on the other side. This results in the best possible stiffness with the shallowest constructional height.

In a preferred embodiment, the base surfaces of the supporting feet are substantially rectangles of which one centre line extends in the direction of the limbs of the beam triangle and is longer than the other centre line. The greater the radial extent of the base surface, the better can the arising moments be transmitted.

Further, the base surfaces of the supporting feet can be made circular. Such a circular face concentric with the bore has the advantage that the same amount of material is available to both sides of the hole and therefore crooked tightening is avoided. However, the base surface need not be completely circular.

It is also favourable if the sound damping chambers have a closed base on the side facing the supporting device and are each closed by a cover on the open side. In this way the base of the sound damping chambers can be utilised as part of the beam triangle and possibly carry individual supporting feet.

In order to save additional assembly steps, it is recommended that the sound damping chamber on one side of the cylinder forms a suction sound damper and the sound damping chamber on the other side a pressure damper, that a connecting passage to the suction and pressure sound damper opens on each side of the cylinder bore into an end face coverable by the cylinder head, and that a one-sidedly secured suction valve spring has its free end near the opening of the connecting passage to the suction sound damper. By merely placing on the cylinder head with suction valve and pressure valve chamber, the connection between the cylinder and the two sound damping chambers is established, the least possible suction resistance being created on the suction side by reason of the position of the suction valve spring.

Further, a projecting lug should be formed at the level of the beam on the side of the bearing opposite thereto. This lug first of all forms an accumulation of material which, during cooling of the casting, counteracts the accumulation of material caused by the beam and reduces stresses and the formation of funnels.

In this connection a projecting lug could also be formed at the level of the beam in the region of each supporting foot. During machining, the component can then be held at these three lugs by means of suitable clamping tools or the like. Damage of the functionally essential parts of which the component, incidentally, consists practically exclusively, is therefore avoided. In addition, one or more lugs may also serve as abutments or for applying springs for the resilient suspension.

However, if the springs engage the stator, it will not be necessary to construct the component so as also to serve for the resilient suspension.

With a vertical motor crank shaft and the compressor at the top, the springs desirably engage the underside of the stack of stator laminations. The supporting device must then transmit to the stator the weight of the one-piece component and of the rotor as well as the moment exerted by the bearing and rotor as well as the motor forces.

The invention will now be described in more detail with reference to an embodiment illustrated in the drawing, wherein.

Figure 1:
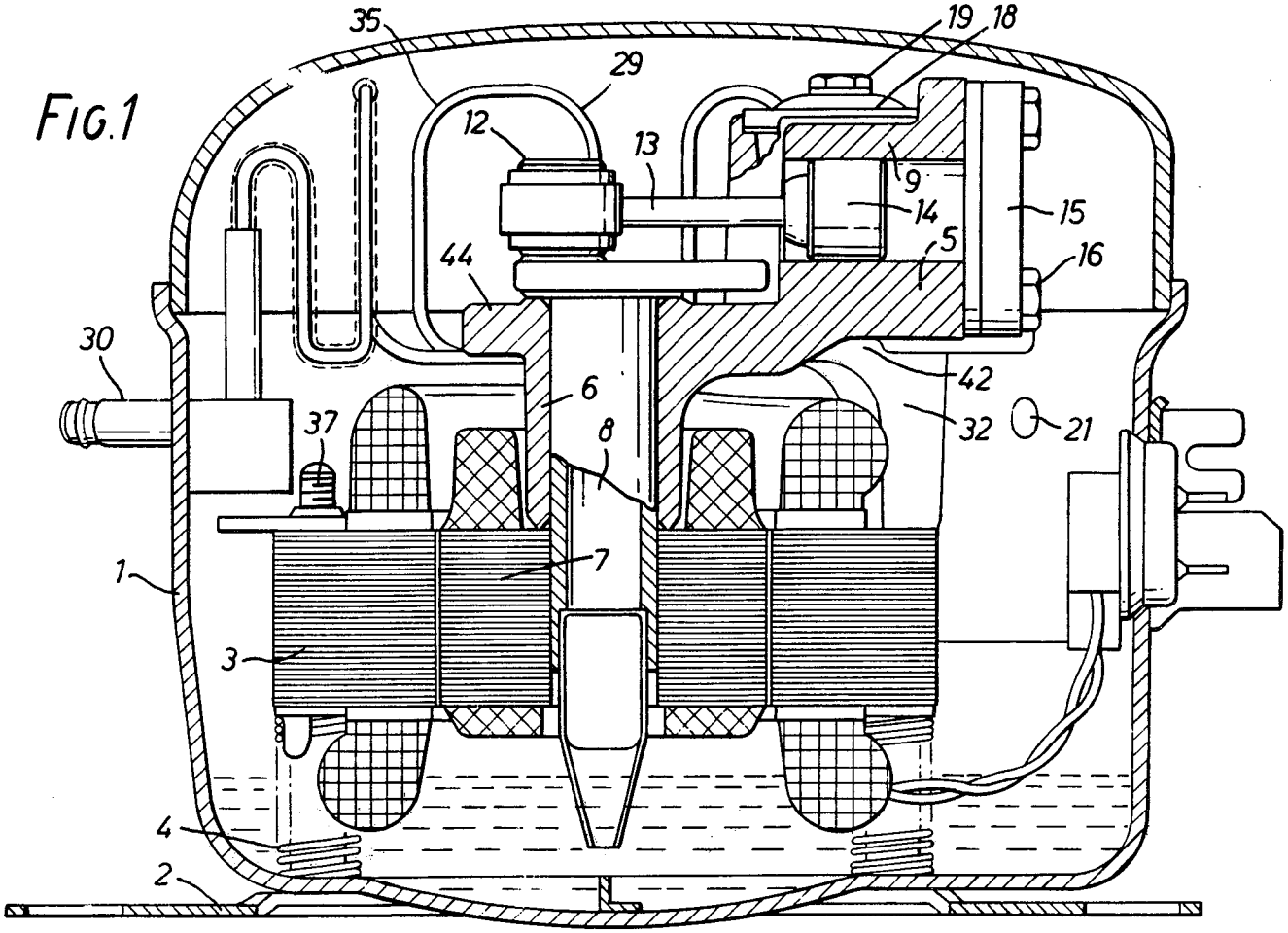
FIG. 1 is a longitudinal section of a motor compressor according to the invention.
Figure 2:
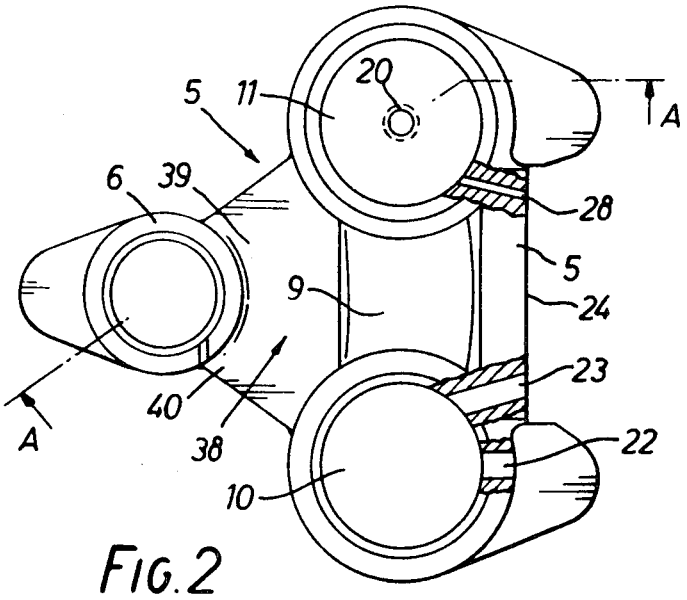
FIG. 2 is a plan view of the component comprising the bearing, cylinder and sound damping chambers.
Figure 3:
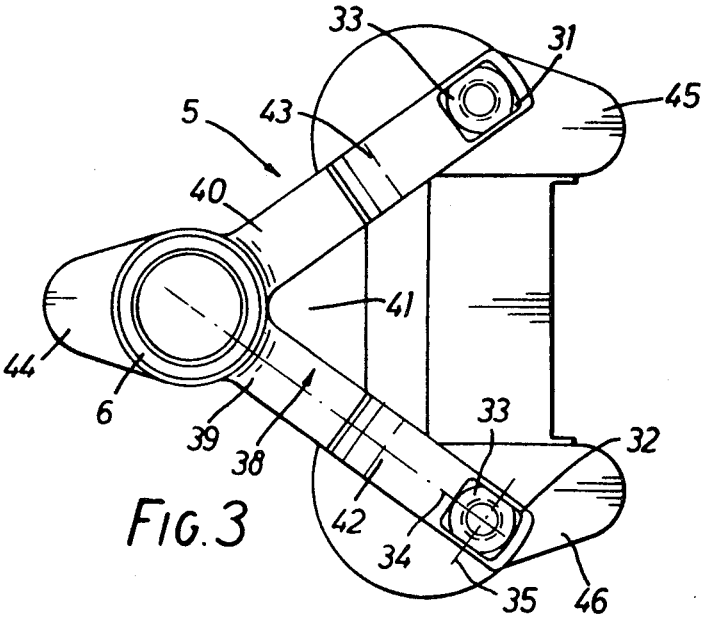
FIG. 3 is an underplan of the component.
Figure 4:
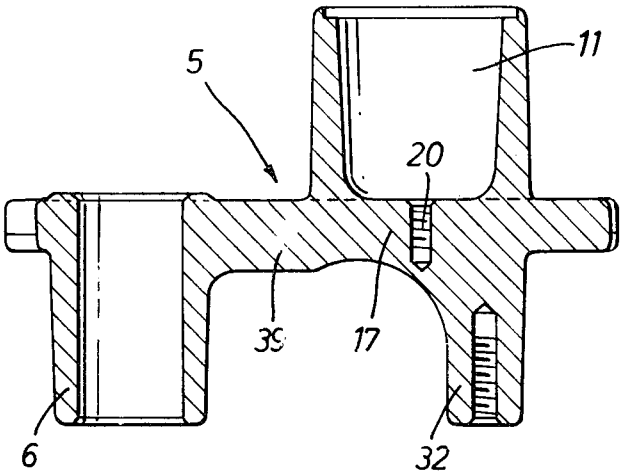
FIG. 4 is a section on the line A—A in FIG. 2.
Figure 5:
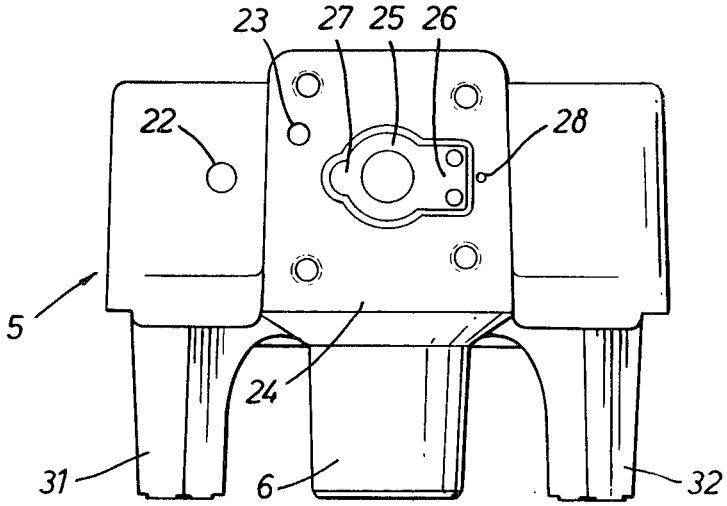
FIG. 5 is an end view of the component.

In a capsule 1 resting on a supporting plate 2 there is resiliently mounted a stator 3 of an electric motor by means of springs 4 engaging at the bottom. A bearing 6 for a motor crank shaft 8 carrying the motor 7, a cylinder 9, a suction sound damping chamber 10 arranged to one side thereof and a pressure damping chamber 11 arranged to the other side thereof are combined as a cast component 5 secured to the stack 3 of stator laminations. A crank pin 12 drives a piston 14 through a connecting rod 13. A cylinder head 15 is attached to the end of the cylinder 9 by means of bolts 16. The sound damping chambers are closed at the bottom by a base 17 and are provided at the top with a cover 18. This cover can simply be pressed into the suction sound damper; in the case of the pressure sound damper it is retained by means of a bolt 19 engaging in a tapped hole 20.

Suction gas passes through a suction gas aperture 21 into the interior of the capsule, reaches the suction sound damping chamber 10 through a suction hole 22 and then passes to the end 24 through a connecting passage 23. Here a suction valve plate 25 is secured to its end 26 whilst its free end 27 faces the mouth of the connecting passage 23. A further connecting passage 28 leads to the pressure sound damper 11. A pressure tube 29 leading to an outlet connection 30 is secured in its cover 18. The valve chambers in the cylinder head 15 are so formed that they create the appropriate paths between the connecting passage 23 and the reciprocating chamber as well as between the reciprocating chamber and the connecting passage 28 by way of the respective valves.

Beneath the sound damping chambers but somewhat beyond their centre lines, the component 5 comprises two supporting feet 31 and 32. These each have a base surface 33 approximating the shape of a rectangle of which one centre line 34 extends in the direction of the bearing 6 and is longer than the other centre line 35. Within the base surfaces there are two tapped holes 36 in which two of the four bolts 37 engage and hold the stack of stator laminations together. The base surfaces 33 are made circular and concentric to the tapped hole 36.

The component 5 further comprises a beam 38 in the form of a triangle holding the bearing 6. This beam triangle has a base formed by the base 17 of the sound damping chambers 10 and 11 as well as the underside of the cylinder 9 and possesses two limbs 39 and 40 extending from the bearing 6 substantially in the direction of the supporting feet 31 and 32. The space between the limbs 39 and 40 is filled with material 41 to provide a closed wall. Either over the entire length or at least near the supporting feet 31, 32, the limbs are formed as stamped-out stays 42, 43 which form a transition and are enlarged towards the base surface of the supporting feet.

Provided at the level of the triangular support there are three outwardly projecting lugs which can be engaged by holding tools during machining, for example along the transfer path. A first lug 44 is arranged on the side of the bearing 6 opposite the supporting triangle 41. Second and third lugs 45 and 46 are provided in the region of the supporting feet.

During assembly, the component 5 is pre-assembled with the motor crank shaft 8, rotor 7, connecting rod 13 and piston 14 and then screwed tight to the stator by means of two stator bolts 37 before this arrangement is mounted on the springs 4 in the capsule.

We claim:

1. A motor compressor assembly for refrigerators, comprising a casing, a motor including a rotor and a stator resiliently mounted in said casing for rotation about a vertical axis, said stator including a stack of laminations, a vertically extending motor shaft having a crank at the upper end thereof spaced from said rotor, a bearing member for said shaft disposed between said crank and said rotor, a beam member attached to and extending laterally from said bearing member, a cylinder member at the radially outer end of said beam member, a piston for said cylinder member, a connecting rod connecting said piston to said crank, support means extending downwardly from said radially outer end of said beam member and engaging the top of said stack of laminations, and fastening means for attaching said support means to said laminations.

2. A motor compressor according to claim 1 including at least one sound damping chamber at the radially outer end of said beam member adjacent said cylinder member.

3. A motor compressor according to claim 1 including two sound damping chambers at the radially outer end of said beam member on opposite sides of said cylinder member.

4. A motor compressor according to claim 3 wherein said beam member is substantially triangularly shaped with legs extending substantially symmetrically from said bearing member, said sound damping chambers being disposed at the ends of said legs.

5. A motor compressor according to claim 1 wherein said fastening means include stator bolts passing through said stack of stator laminations and tapped holes in said support means.

6. A motor compressor according to claim 1 wherein said support means includes two post members depending from opposite sides of said cylinder member.

7. A motor compressor according to claim 3 wherein said cylinder member and said sound damping chambers are disposed on the upper side of said beam member.

* * * * *